US005132696A

United States Patent [19]

Cobb

[11] Patent Number: 5,132,696

[45] Date of Patent: Jul. 21, 1992

[54] PNEUMATIC EXTENDABLE ANTENNA FOR WATER DEPLOYABLE BUOY

[75] Inventor: Jack M. Cobb, San Juan Capistrano, Calif.

[73] Assignee: Hughes Aircraft Company, Los Angeles, Calif.

[21] Appl. No.: 599,767

[22] Filed: Oct. 18, 1990

[51] Int. Cl.[5] ..... H01Q 1/34

[52] U.S. Cl. ..... 343/709; 343/902

[58] Field of Search ..... 343/709, 900, 902, 901, 343/790, 791

[56] References Cited

U.S. PATENT DOCUMENTS

| | | | |
|---|---|---|---|
| 2,172,117 | 9/1939 | Beaufort et al. | 343/902 |
| 2,534,710 | 12/1950 | Golian et al. | 343/709 |
| 2,593,432 | 4/1952 | Freas | 343/902 |
| 2,646,504 | 7/1953 | Gosline | 343/902 |

FOREIGN PATENT DOCUMENTS

| | | | |
|---|---|---|---|
| 2396432 | 3/1979 | France | 343/902 |

*Primary Examiner*—Michael C. Wimer
*Assistant Examiner*—Hoanganh Le
*Attorney, Agent, or Firm*—Wanda K. Denson-Low

[57] ABSTRACT

A water-deployable whip antenna is extendable from a shortened configuration to a lengthened configuration. The body of the antenna is made up of a plurality of hollow frusto-conical segments which are slidably nested inside each other when the antenna is in its shortened configuration. To telescope the segments and thereby place the antenna in its lengthened operational configuration, a compressible container is housed within the segments. When the container is filled with pressurizing gas, the container expands to telescope the segments relative to each other. Additionally, a weighted ballast and electronic control circuitry are attached to one end of the antenna. In order to float the antenna in a vertical orientation, an air-filled stability bag is disposed around the antenna near the antenna's weighted end.

13 Claims, 2 Drawing Sheets

PNEUMATIC EXTENDABLE ANTENNA FOR WATER DEPLOYABLE BUOY

FIELD OF THE INVENTION

The present invention relates generally to systems and apparatus for transmitting radiofrequency (RF) waves. More particularly, the present invention relates to RF antennas that are deployable on the surface of a body of water for remote control communications. The present invention is particularly, though not exclusively, useful for deploying buoyant RF antennas from submersibles that have relatively limited space for storing the antenna.

BACKGROUND OF THE INVENTION

As is widely known, communicating with manned and unmanned submersibles at sea presents unique challenges. The very reason for the effectiveness of these stealthy platforms —the relative opacity of the ocean depths to electromagnetic radiation—makes real-time communication with submersibles the most difficult command and control problem facing the world's navies today. In fact, it is the case that the desire for real-time, continuous, and reliable two-way communication between submersibles and other communication nodes is at odds with the exigencies of submarine operations. Notwithstanding, a wide variety of communications systems have been developed to help ameliorate the difficulties which characterize submarine communications. These systems aggregately use the full communications frequency spectrum, from super high frequency (SHF) communications systems between submersibles and satellite relay nodes to extremely low frequency (ELF) communications systems which use land-based antennas that are several miles in length. In addition to the more conventional communications systems, recent developments in blue-green laser technology have made laser communications with submersibles feasible It is the case, however, that no single communications system has yet been developed that is without significant shortcomings. For example, communications systems which permit the submersible to remain covert by communicating at relatively deep water depths, such as laser communications and ELF, also have inherently low data transmission rates. Thus, only a limited amount of data per a given time period may be transmitted via these systems. Moreover, it is generally the case that due to transmitter size requirements, systems such as ELF can support only one-way communication to the submarine. On the other hand, high frequency (HF), ultra high frequency (UHF), and super high frequency (SHF) communications are capable of supporting real-time, high data rate, two-way communication between submarines and surface vessels, aircraft, or satellites. Unfortunately, in order to employ such systems, the submarine typically must operate close enough to the ocean's surface to permit raising a communications mast or antenna above the surface of the water. This requirement in turn restricts the submarine's operating envelope and reduces the submarine's acoustic sensing capabilities as well as its overall covertness, all of which factors deleteriously affect submarine operations. Moreover, permitting a submarine to remain deep while communicating is important even when covertness is of little concern. For example, an unmanned research submersible that can communicate with off-hull nodes while remaining deep accordingly avoids undue interference with its operating schedule or routine.

Several communications systems have been developed which attempt to exploit the advantages of real-time, relatively high data rate HF and UHF communications, while permitting the submarine to remain relatively deep while communicating. Foremost among these systems are communication buoys. Communication buoys are devices which may be pre-programmed with a message, then deployed by the submersible to float to the water's surface in order to transmit the pre-programmed message to a satellite or other communications node. Some of these devices are additionally equipped with a small transducer, which gives the buoy the capability to acoustically re-transmit message to the submersible that are received by the buoy on radio frequencies. In any case, it is evident that such devices must incorporate an appropriately oriented RF antenna in order to transmit and receive messages over HF and UHF frequencies. Moreover, the antenna of such a device must be sufficiently large to be functionally effective. On the other hand, many such devices may be required by the submersible over a period of time. Therefore, the antenna of the device must be configurable to facilitate storage of several of the devices in the relatively small and limited storage spaces of a submersible. To meet these requirements, some communication buoys have been proposed that have an antenna which is movable between a shortened and a lengthened configuration, similar to an automobile antenna. Like many remote-controlled automobile antennas, the antenna associated with several of these types of communications buoys are telescoped by a motor and drive screw actuator. It will be immediately recognized, however, that such an actuator is inherently relatively heavy and expensive, both of which attributes are fundamentally incompatible with the need for deploying a large number of reliable, yet light weight and buoyant, communications buoys.

Accordingly, it is an object of the present invention to provide a deployable antenna for underwater launched communications buoys which is sufficiently large to be functional as a UHF antenna. It is another object of the present invention to provide a deployable antenna for underwater launched communications buoys that is sufficiently compact to permit storage in a relatively small area. Yet another object of the present invention is to provide a deployable antenna for underwater launched communications buoys which is buoyant and which may be oriented to maximize communications connectivity across the antenna. Still another object of the present invention is to provide a deployable antenna for underwater launched communications buoys that is relatively inexpensive and cost effective to manufacture.

SUMMARY OF THE INVENTION

A deployable, buoyant whip antenna has a body which is extendable between a shortened configuration and a lengthened configuration. More particularly, the body comprises a plurality of hollow, lightweight frusto-conical segments which are slidably nested inside each other when the antenna is in its shortened configuration. Each segment is tapered from a wide base end to a narrow base end with the nested segments describing progressively smaller volumes from outermost to innermost segment. Specifically, while the segments are all of approximately equal length, the respective wide and narrow base ends of the segments have progressively smaller diameters from the outermost segment to the innermost segment. To place the antenna in its lengthened configuration, the segments are telescoped relative to each other. In order to telescope the segments, a compressible container, such as a corrugated plastic bellows, is disposed within the hollow segments. When the chamber formed by the container is filled with a pressurizing agent, such as compressed gas, the container expands lengthwise to telescope the segments. When the segments are urged into this lengthened, telescoped configuration, each segment forms an interference fit with the next respective segment of the telescoped body, the segments thereby locking together in the telescoped configuration. More particularly, the segments lock in this lengthened, telescoped configuration because the wide base end of each segment is slightly larger than the narrow base end of the next respectively larger segment in which the smaller segment was nested. Thus, an interference fit is formed between successive narrow and wide base ends.

Additionally, in the area of the interference fit, the wide and narrow ends of each of the segments is silver plated to establish an efficient electrical contact between the segments. A means to maintain the antenna in a vertical orientation relative to the water's surface is also provided. More specifically, a weighted ballast is attached to one end of the body. A buoyant device, such as plastic air-filled stability bags, may then be disposed around the antenna between the ballast and the body and, in combination with the effect of the weighted ballast, thereby float the antenna in a vertical orientation. Electronic control and power equipment, as appropriate, are also attached to the antenna near the weighted end of the body.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
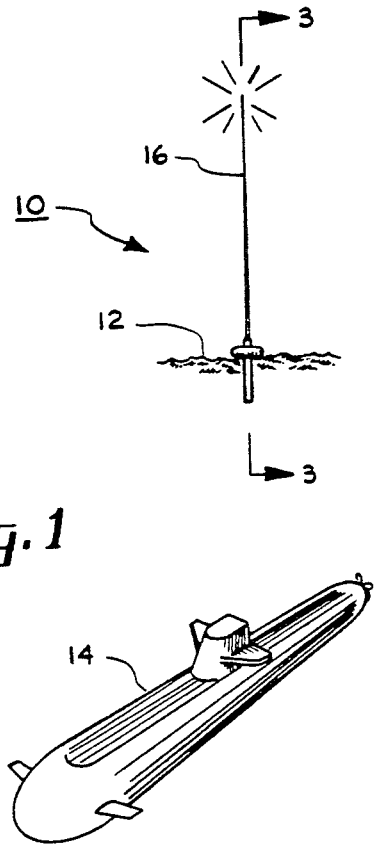
FIG. 1 is a perspective view of the pneumatic deployable antenna of the present invention in its telescoped configuration after deployment.

Referring initially to FIG. 1, a pneumatic deployable antenna, generally designated 10, is shown in its intended environment. More particularly, antenna 10 is shown floating in a substantially vertical orientation with respect to water surface 12, after being deployed by submersible 14. Although a submersible 14 is shown in FIG. 1, it is to be understood that other platforms may employ antenna 10, such as anti-submarine aircraft (not shown).

Figure 3:
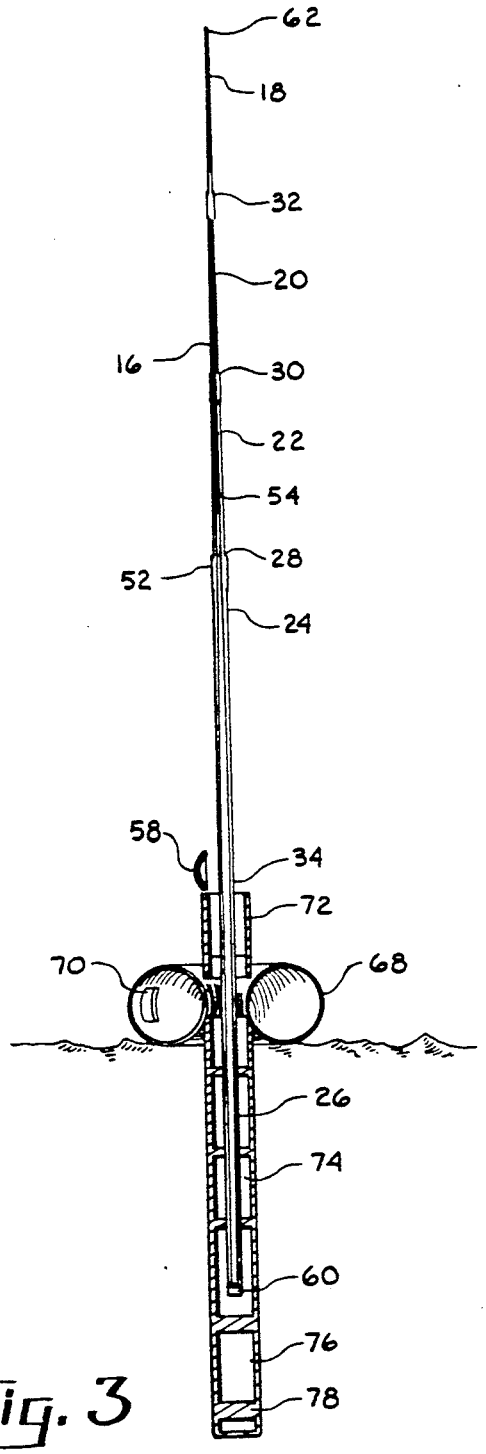
FIG. 3 is a cross-sectional view of the pneumatic deployable antenna of the present invention as seen along the line 3—3 in FIG. 1.
Figure 2:
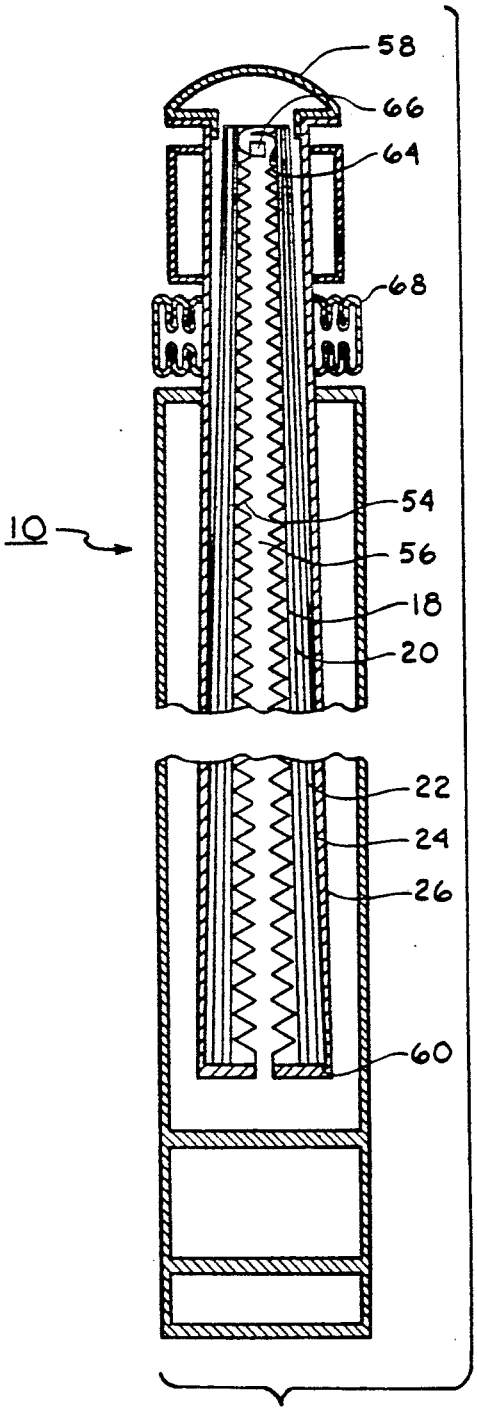
FIG. 2 is a side cross-sectional view of the pneumatic deployable antenna of the present invention in its nested configuration with portions cut away for clarity.

As best seen by cross-referencing FIGS. 2 and 3, antenna 10 is extendable from a shortened configuration to a lengthened configuration. More particularly, prior to deployment, the segments 18, 20, 22, and 24 of body 16 are nested within each other and are housed within antenna chamber 26, as shown in FIG. 2. When antenna 10 is in this shortened configuration, it will be appreciated that antenna 10 comprises a minimum volume to thereby facilitate storage of antenna 10 in small or otherwise size-limited storage spaces aboard submersible 14. Then, after deployment by submersible 14, antenna 10 is placed in its lengthened configuration shown in FIG. 3 by a mechanism to be disclosed shortly. As the skilled artisan will appreciate, when antenna 10 is in the lengthened configuration shown in FIG. 3, it may be used as a transmitting and receiving antenna for a wide variety of radiofrequency (RF) transceivers that may be associated with antenna 10.

Figure 4:
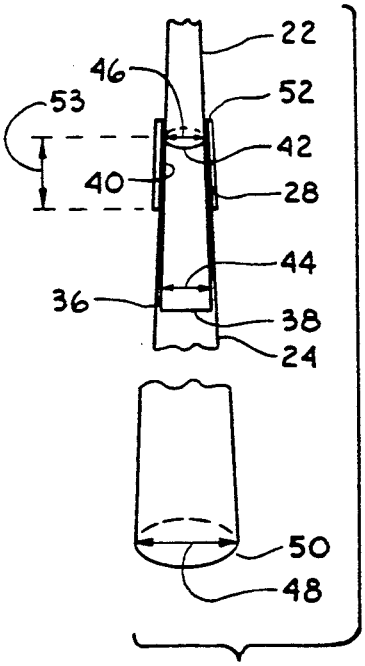
FIG. 4 is a perspective view of one segment joint of the pneumatic deployable antenna of the present invention, with the taper of the segments exaggerated for illustration and with the bellows removed for clarity.

The details of antenna 10 are perhaps best seen in reference to FIGS. 2, 3, and 4. In FIG. 3, it will be seen that for the embodiment shown, body 16 comprises four hollow segments 18, 20, 22, and 24, although it is to be understood that a greater or lesser number of segments may comprise body 16 without departing from the scope of the present invention. As seen in FIGS. 2 and 3, segments 18, 20, 22, and 24 describe substantially right circular frusto-conical volumes, each segment describing a passageway therethrough, with the passageways of the respective segments accordingly being in axial alignment. It is to be further understood, however, that various geometric shapes of segments 18, 20, 22, 24 may be used, such as pyramidal frustums. To facilitate the use of antenna 10 as an RF antenna, it will be appreciated that segments 18, 20, 22, and 24 are composed of an electrically conductive material, such as aluminum or, preferably, a relatively lightweight graphite composite material. More particularly, a lightweight material for the construction of segments 18, 20, 22, 24 is preferred to permit use of a relatively lightweight, inexpensive bellows 54. Such a lightweight bellows 54 in turn permits the use of lower gas activation pressure during the operation of antenna 10 disclosed below. To these ends, the preferred embodiment of antenna 10 envisions the use of a material for segments 18, 20, 22, 24 which is made of unidirectional graphite fibers encapsulated by an epoxy or thermoplastic resin. Moreover, to provide for superior radiofrequency conductivity and mechanical strength, the individual fibers of the graphite material which comprises each of the segments 18, 20, 22, 24 are canted at approximately a fifteen (15) degree offset from the longitudinal centerline of the segments 18, 20, 22, 24.

In cross-reference to FIGS. 2 and 3, it is seen that each segment of body 16 is progressively smaller in size. In particular, while the segments 18, 20, 22, 24 describe right circular frusto-conical volumes of substantially equal altitudes, the areas of the respective bases (and, hence, volumes) of segments 18, 20, 22, 24 become progressively smaller. Specifically, the diameter of the wide base of each segment is marginally smaller than the diameter of the wide base of the next largest segment. Similarly, the diameter of the narrow base of each segment is marginally smaller than the diameter of the narrow base of the next largest segment. Thus, segment 18, which is the innermost segment in the nested configuration of antenna 10 shown in FIG. 2 and the top-most segment in the telescoped configuration of antenna 10 shown in FIG. 3, is volumetrically the smallest segment of body 16. In accordance with the above disclosure, segment 20 is volumetrically larger than segment 18, segment 22 is volumetrically larger then segment 20, and segment 24 is volumetrically the largest segment of body 16. To illustrate, in one embodiment of antenna 10, the segments 18, 20, 22, 24 are each approximately two (2) feet long. The inside diameters of the respective wide base ends of the segments, however, progressively decrease in this illustrative embodiment from approximately one (1) inch in the case of segment 24 to approximately one-half (0.5) inch in the case of segment 18. The corresponding range of the inside diameters of the narrow base ends of segments 18, 20, 22, 24 is approximately eighty-five one-hundredths (0.85) of an inch for segment 24 to approximately thirty-eight one-hundredths (0.38) of an inch for segment 18. Finally, the walls of each segment are approximately one one-hundredth (0.01) of one inch thick.

To more fully disclose the size relationship between the segments 18, 20, 22, and 24, the joint 28 between segments 22, 24 is shown in FIG. 4. It is to be understood, however, that the following description of joint 28 also applies to the other segment-segment joints, designated 30, 32 in FIG. 3, as well as the joint 34 between segment 24 and antenna chamber 26. Specifically, in reference to FIG. 4, the joint 28 is formed by an interference fit between the outer surface 36 of wide base end 38 of segment 22 and the inner surface 40 of narrow base end 42 of segment 24. It will therefore be appreciated that diameter 44 of wide end 38 is marginally larger than diameter 46 of narrow end 42. On the other hand, diameter 44 is smaller than diameter 48 of wide end 50 of segment 24, as disclosed above. Thus, antenna 10 may be placed in the lengthened configuration shown in FIG. 3, in which the segments 18, 20, 22, and 24 form interference fits at their respective joints to thereby lock in their telescoped relationship. More specifically, in reference to FIG. 4, when the segments 22 and 24 are tapered substantially as disclosed, it will be understood that in the telescoped configuration described above, the segments 22 and 24 form an annular-shaped interference fit therebetween at joint 28 that is approximately one and one-half (1.5) inches long in the axial direction, indicated by length 53. Additionally, to facilitate an effective electrical contact between segments, using joint 28 in FIG. 4 as an example, both outer surface 36 of segment 24 and inner surface 40 of segment 22 may be plated with an electrical conductor, such as silver (Ag). Further, to strengthen the segment joints, and again using the joint 28 shown in FIG. 4 as an example, a ferrule ring 52 may be disposed around and outside joint 28 by any suitable means, such as by bonding a portion of ferrule 52 to the outer surface of segment 24. Finally, FIG. 4 shows a bellows 54 after it has been expanded with $CO_2$ gas to telescope the segments 22, 24.

Figure 5:
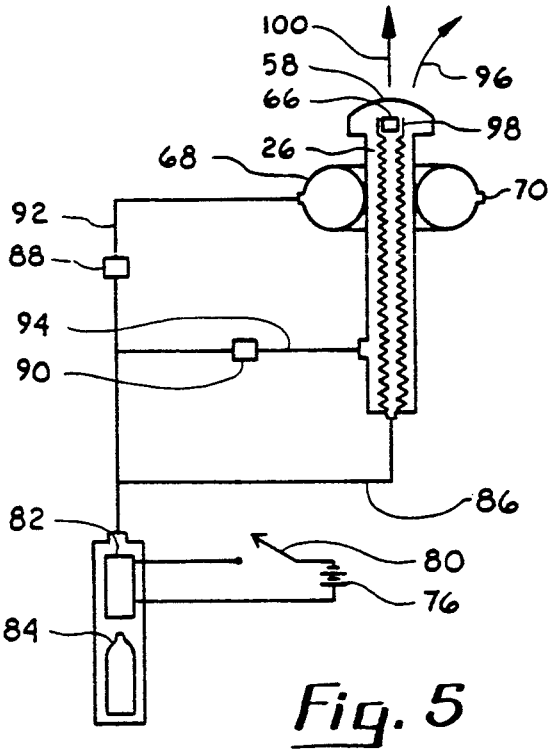
FIG. 5 is a schematic diagram of the actuating system of the pneumatic deployable antenna of the present invention.

With regard to bellows 54, it is to be understood that any suitable expandable container, such as the corrugated plastic bellows 54 shown in FIGS. 2, 4, and 5, is disposed within antenna body 16 to extend antenna 10 into its lengthened configuration shown in FIG. 3. In particular, as shown in FIG. 2, bellows 54 forms an airtight chamber 56 which may be filled with a suitable pressurizing agent, such as compressed carbon dioxide ($CO_2$) gas, to expand and rigidize the bellows 54. When antenna 10 is in the shortened configuration shown in FIG. 2, bellows 54 is compressed within antenna chamber 26 between cap 58 and end 60 of chamber 26. On the other hand, after being expanded to the configuration shown in FIG. 3, bellows 54 extends the length of antenna 10 from end 60 of chamber 26 to free end 62 of segment 18. Additionally, bellows 54 may be comprised of any suitable lightweight material, such as plastic. FIG. 2 also shows a pressure relief valve 66 which may be disposed in end 64 of bellows 54 for operation to be disclosed shortly.

In referring to FIGS. 2 and 3, a buoyant container 68 is shown disposed circumferentially around antenna 10. It is to be understood that container 68 may be filled with compressed gas to change container 68 from its deflated state, shown in FIG. 2, into its inflated state, shown in FIG. 3. Operationally, container 68 is inflated after antenna 10 deployment to keep antenna 10 buoyant and oriented in a substantially vertical direction relative to the surface of the water on which antenna 10 is deployed. As shown in FIG. 3, container 68 substantially forms a circular donut around antenna 10 when container 68 is inflated. Like the rest of the components of antenna 10, container 68 is preferably composed of a lightweight, inexpensive material, such as plastic. Container 68 may also incorporate any means well known in the art that is suitable for deflating container 68 to thereby scuttle antenna 10 after a predetermined period of time. For example, container 68 may be formed with a salt window 70, which comprises a water-soluble membrane that dissolves after being in contact with water after a predetermined time, to deflate container 68.

FIG. 3 also shows a plurality of watertight auxiliary structures disposed around antenna chamber 26. More particularly, a pneumatic control chamber 72 is shown attached to antenna chamber 26. Not shown in FIG. 3 but mounted within chamber 72 are the pneumatic control valves and lines which telescope antenna 10 in a manner which will shortly be disclosed. In addition to pneumatic control chamber 72, an electronic chamber 74 is shown in FIG. 3 disposed around antenna chamber 26. As the skilled artisan will readily appreciate, electronic chamber 74 contains the electronic components of an appropriate RF transceiver, such as the U.S. government type designated AN/BRT-1. These components include devices which match the impedance of body 16 to the impedance of the circuitry contained within chamber 74, as well as frequency control circuitry, signal conditioning and amplifying circuitry, and message storage circuitry for transmitting messages over antenna 10 at preselected times and intervals. To power the electronic and pneumatic control components of antenna 10, a suitable power supply, such as battery 76, is provided. Like the other components of antenna 10 described above, battery 76 is preferably lightweight and inexpensive. Finally, to maintain the vertical orientation of antenna 10 in cooperation with floatation container 68, a suitable weighted ballast 78, such as a lead mass, may be attached to antenna 10 substantially as shown in FIG. 3.

OPERATION

In the operation of deployable antenna 10, reference is made to FIGS. 1, 2 and 5. It is to be appreciated that prior to deployment, antenna 10 is in its shortened configuration shown in FIG. 2. In this configuration, antenna 10 may be efficaciously stored within and then deployed from a platform, for example the submersible 14 shown in FIG. 1, by loading and firing antenna 10 out of a signal ejector device (not shown) which is onboard submersible 14.

Using submerged deployment as one example of how antenna 10 might be deployed, it is to be appreciated that antenna 10 is normally ejected by a submersible 14 near the surface of the water, in a direction which is toward the water's surface. In disclosing the subsequent pneumatic actuation of antenna 10, reference is made to FIG. 5. There, it may be seen that a pressure switch 80 is electrically connected between an actuator 82 and battery 76. Pressure switch 80 is any suitable device which senses sea water pressure (and, hence, the water depth of antenna 10) and accordingly closes to complete the circuit between battery 76 and actuator 82 when antenna 10 reaches a predetermined water depth. When battery 76 voltage is subsequently applied to actuator 82, actuator 82 induces carbon dioxide ($CO_2$) cotainer 84 to release pressurized $CO_2$ gas into gas line 86. Actuator 82 may comprise any suitable pyrotechnic device, such as a SQUIB device, that can induce $CO_2$ container 84 to release $CO_2$ gas, such as by puncturing container 84. Valves 88 and 90, however, initially remain closed to prevent pressurization of gas lines 92 and 94, respectively. It is to be understood that valves 88, 90, and 66 comprise any suitable mechanisms, such as ball-spring valves, which are normally closed but which will open when a predetermined pressure differential is applied across the valve. As seen in FIG. 5, when the integrity of $CO_2$ container 84 is breached, $CO_2$ gas is directed through gas line 86 into bellows 54 to begin pressurizing bellows 54. Bellows 54 is initially prevented from expanding, however, by the constraint imposed on it by cap 58 of antenna chamber 26. Additionally, the $CO_2$ gas is initially prevented from escaping from bellows 54 by normally closed pressure relief valve 66. During operation, valve 66 remains shut until a pressure differential of more than fifty (50) pounds per square inch (gauge) (PSIG) is placed across pressure relief valve 66.

As seen in FIG. 5, after $CO_2$ container 84 is activated, $CO_2$ gas is ported into bellows 54 through line 86, which causes pressure in bellows 54 (and line 86) to rise. Eventually, as $CO_2$ gas is continuously ported into line 86, the pressure across valves 88, 90 rises until this pressure differential reaches approximately fifty (50) PSIG. When such a pressure differential across valves 88, 90 is reached, valves 88, 90 open to port $CO_2$ gas through lines 92, 94, respectively, and thence into container 68 and antenna chamber 26, respectively. Thus, container 68 is inflated with $CO_2$ gas to float antenna 10. Concurrently, when $CO_2$ gas pressure in antenna chamber 26 reaches fifteen (15) PSIG, cap 58 is urged outward by $CO_2$ gas pressure from antenna chamber 26 in the direction of arrow 96. It will be appreciated that at this point in the antenna 10 actuation cycle, bellows 54 becomes free to expand in the direction of arrow 100 in response to the $CO_2$ gas pressure within bellows 54. Moreover, because end 98 of bellows 54 is in contact with segment 18, (not shown in FIG. 5), segment 18 is also urged upwardly in the direction of arrow 100. As segment 18 slides out of chamber 26 in the direction of arrow 100, the outer surface of the wide end of segment 18 eventually contacts the inner surface of the narrow end of segment 20, in which segment 18 is initially nested. Segments 18, 20 consequently lock in the interference fit thus formed, in accordance with previous disclosure.

It will be appreciated that as $CO_2$ gas pressure continues to expand bellows 54, segment 18 is correspondingly urged further in the direction of arrow 100 until each of the segments 18, 20, 22, and 24 has telescoped in accordance with the disclosure above to form the lengthened configuration of body 16 shown in FIGS. 1 and 3.

Again referring to FIG. 5, shortly after cap 58 has been detached from chamber 26 and bellows 54 consequently begins to expand as described above, the pressure differential across now-open valves 88, 90 decreases to below fifty (50) PSIG. Thus, at this point in the actuation cycle, valves 88, 90 close and thereby substantially lock $CO_2$ gas in container 68 and chamber 26, respectively. More particularly, valves 88, 90 are biased to close at a pressure differential of about thirty-five (35) PSIG, so that pressure within chamber 26 and container 68 is locked at approximately fifteen (15) PSIG. Thus, container 68 is maintained in an inflated configuration and will remain inflated until scuttled, such as by the operation of salt window 70 disclosed previously. It will be readily appreciated, however, that once segments 18, 20, 22, and 24 have telescoped, chamber 26 becomes open to the surrounding air/water environment. Hence, pressure within chamber 26 will tend to equalize with the ambient pressure of the environment that surrounds antenna 10. Moreover, it will be recognized that once valves 88, and 90 close and bellows 54 has fully extended body 16 into its lengthened configuration, the interior of bellows 54 may continue to undergo pressurization from residual $CO_2$ gas within $CO_2$ gas container 84. It may now be appreciated that in such an event, pressure relief valve 66 opens to prevent over pressurizing bellows 54 when the pressure differential between bellows 54 and chamber 26 substantially exceeds an appropriate value, preferably about fifty (50) PSIG. It will be further appreciated by the skilled artisan that while the segments 18, 20, 22, 24 rigidly lock in their telescoped configuration in accordance with previous disclosure, bellows 54 further adds to the rigidity of antenna 10. More specifically, because the interior of bellows 54 is maintained at a higher pressure relative to the ambient pressure surrounding bellows 54, bellows 54 (and, hence, antenna 10) is further rigidized to help maintain segments 18, 20, 22, 24 in their locked, telescoped configuration.

While the particular pneumatic deployable antenna for underwater launched buoy as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A water deployable whip antenna which comprises:

an extendable body reconfigurable between a shortened configuration and a lengthened configuration;

a source of pressurized gas;

an expandable vessel in fluid communication with said source of pressurized gas for reconfiguring said body from said shortened configuration to said lengthened configuration, said vessel being disposed within said extendable body, said vessel extending said expandable body to establish said lengthened configuration when said vessel is filled with pressurized gas; and buoyant means for establishing a predetermined orientation of said extendable body in water.

2. A depolyable whip antenna as recited in claim 1 wherein said extendable body comprises a plurality of frusto-conical sections, said sections being slidably reconfigurable between said shortened configuration of said extendable body wherein said sections are nested one inside the other and said lengthened configuration of said extendable body wherein said sections are telescoped relative to each other.

3. A depolyable whip antenna as recited in claim 2 wherein said body further comprises a weighted end and a free end.

4. A deployable whip antenna as recited in claim 1 wherein said buoyant means includes an inflatable container disposed around said antenna.

5. A deployable whip antenna as recited in claim 3 wherein said predetermined orientation of said antenna is established with said free end of said antenna extending substantially directly above said weighted end of said antenna with respect to the earth's surface.

6. A deployable whip antenna as recited in claim 1 wherein said body is made of an electrical conductor.

7. A deployable whip antenna as recited in claim 6 wherein said body is made of a graphite composite material.

8. A depolyable whip antenna as recited in claim 1 further including an antenna chamber within which said extendable body is disposed in the shortened configuration, said antenna having separatable cap means to allow extension of said extendable body out of said chamber.

9. A depolyable whip antenna as recited in claim 8 wherein said cap means separates from said antenna chamber at a first predetermined pressure;

and further including means for coupling gas from said source of pressurized gas to said expandable container and to said antenna chamber;

said means for coupling gas including a first pressure-activated valve disposed between said source of pressurized gas and said antenna chamber, said first pressure-activated valve opening at pressure differential greater than a first predetermined pressure differential across said first pressure-activated valve and closing at a second predetermined pressure differential across said first pressure-activated valve.

10. A deployable whip antenna as recited in claim 9 wherein said expandable vessel has a pressure-relief valve which opens at a third differential pressure.

11. A depolyable whip antenna as recited in claim 9 further comprising means for coupling gas from said source of pressurized gas to said inflatable container including a second pressure-activated valve disposed between said source of pressurized gas and said inflatable container, said second pressure-activated valve opening at pressure differential greater than said first predetermined pressure differential across said second pressure-activated valve and closing at said second predetermined pressure differential across said second pressure-activated valve.

12. A depolyable whip antenna as recited in claim 1 wherein said expandable vessel is an inflatable bellows.

13. A depolyable whip antenna as recited in claim 1 wherein said buoyant means includes an inflatable container disposed around said antenna intermediate said weighted end and said free end.

* * * * *